US007352382B2

(12) United States Patent
Arai

(10) Patent No.: US 7,352,382 B2
(45) Date of Patent: Apr. 1, 2008

(54) THERMAL PRINTER

(75) Inventor: Noriyuki Arai, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 11/303,480

(22) Filed: Dec. 16, 2005

(65) Prior Publication Data

US 2006/0139438 A1 Jun. 29, 2006

(30) Foreign Application Priority Data

Dec. 24, 2004 (JP) ..... 2004-372770

(51) Int. Cl.
*B41J 11/42* (2006.01)

(52) U.S. Cl. ..... 347/215; 347/218

(58) Field of Classification Search ..... 347/215, 347/218

See application file for complete search history.

(56) References Cited

U.S. PATENT DOCUMENTS 5,133,616 A * 7/1992 Oyaide et al. ..... 400/635
5,177,574 A * 1/1993 Yoneda ..... 257/306
5,261,754 A * 11/1993 Sugiura ..... 400/636.3
5,369,424 A * 11/1994 Hori et al. ..... 346/134
5,602,571 A * 2/1997 Suda et al. ..... 346/134
5,910,811 A * 6/1999 Sato ..... 347/104
2006/0227195 A1* 10/2006 Arai ..... 347/104

FOREIGN PATENT DOCUMENTS

JP 10-217516 8/1998

* cited by examiner

*Primary Examiner*—Huan Tran
(74) *Attorney, Agent, or Firm*—Canon U.S.A. Inc I. P. Div

(57) ABSTRACT

A thermal printer includes an upstream conveying device and a downstream conveying device that are respectively arranged upstream and downstream of a recording device. The upstream conveying device conveys a recording sheet while a first half of a print region that is adjacent to a print start edge of the recording sheet is being printed on, and the downstream conveying device conveys the recording sheet while a second half of a print region that is adjacent to a print end edge of the recording sheet is being printed on, so that the entire region of the recording sheet can be printed on without leaving margins. In addition, upstream and downstream guides are provided to make the movement of the recording sheet stable during printing.

5 Claims, 3 Drawing Sheets

THERMAL PRINTER

BACKGROUND OF THE INVENTION

1. Field of the Invention

The present invention relates to a thermal printer having a thermal head that functions as a printing device.

2. Description of the Related Art

A thermal dye sublimation printer will be described below as an example of a known thermal printer. First, a printing device will be described. An ink ribbon and a thermal head are arranged on a print surface of a recording sheet, and a platen roller is disposed on the back surface of the recording sheet. To print a desired image on the recording sheet, a plurality of heater elements arranged along a line on the thermal head are selectively caused to generate heat in accordance with image information while the thermal head is being pressed against the platen roller. Accordingly, ink on the ink ribbon is sublimated and transferred onto the recording sheet.

A device for conveying the recording sheet includes a paper feed roller, which is a driving roller that conveys the recording sheet, and a paper press roller that is arranged parallel to the paper feed roller and presses the paper feed roller with a certain tension. Accordingly, the recording sheet is conveyed while being nipped between the two rollers.

The conveying device is placed upstream or downstream of the printing device, and the recording sheet is continuously nipped between the rollers included in the conveying device during the process of printing on the recording sheet.

In color printing, an image of a single color is printed while the recording sheet is conveyed once. A full-color image is obtained by repeatedly driving the paper feed roller in forward and reverse directions and successively printing images of different colors on the recording sheet.

However, in the known printing method, the recording sheet must be continuously nipped between the rollers included in the conveying device during printing, as described above. Therefore, regions near a print start edge and a print end edge of the recording sheet cannot be printed on and margins are formed along these edges.

In order to solve this problem, an upstream conveying device and a downstream conveying device may be respectively arranged upstream and downstream of the printing device in the recording-sheet conveying direction. The recording sheet is conveyed using the upstream conveying device while a first half of a print region that is adjacent to the print start edge is being printed on, and is conveyed using the downstream conveying device while a second half of the print region that is adjacent to the print end edge is being printed on. Accordingly, marginless printing in which no margin is left on the recording sheet can be performed.

Japanese Patent Laid-Open No. 10-217516 discloses a structure for forming a color image over the entire region of a recording medium.

In the above-described print method for marginless printing, the printing device is disposed between the upstream conveying device and the downstream conveying device. Therefore, if the recording sheet cannot be smoothly passed from the upstream conveying device to the downstream conveying device, the conveying speed of the recording sheet varies. As a result, print defects like uneven density and color misalignment may occur in the printed image.

One of the reasons why the above-described problem occurs is deflection of the recording sheet between the upstream conveying device and the downstream conveying device. There are some factors between the upstream conveying device and the downstream conveying device that lead to the deflection of the recording sheet, and these factors are regarded as the causes of reduction of stability in the printing operation.

SUMMARY OF THE INVENTION

The present invention is directed to a thermal printer that can prevent a recording sheet from being deflected between an upstream conveying device and a downstream conveying device to obtain a printed image that is free from print defects like uneven density and color misalignment.

According to one aspect of the present invention, a thermal printer includes an upstream conveying device and a downstream conveying device that are respectively arranged upstream and downstream of a recording device in the conveying direction of a recording sheet. The upstream conveying device conveys the recording sheet while a first half of a print region that is adjacent to a print start edge of the recording sheet is being printed on, and the downstream conveying device conveys the recording sheet while a second half of a print region that is adjacent to a print end edge of the recording sheet is being printed on. In addition, the thermal printer further includes two guide units that define a conveying path of the recording sheet, one of the guide units being positioned between the upstream conveying device and the printing device and the other one of the guide units being positioned between the downstream conveying device and the printing device.

Further features of the present invention will become apparent from the following description of exemplary embodiments with reference to the attached drawings.

DESCRIPTION OF THE EMBODIMENTS

A thermal printer (hereafter sometimes called simply a printer) according to embodiments of the present invention will be described below with reference to the accompanying drawings.

Figure 1:
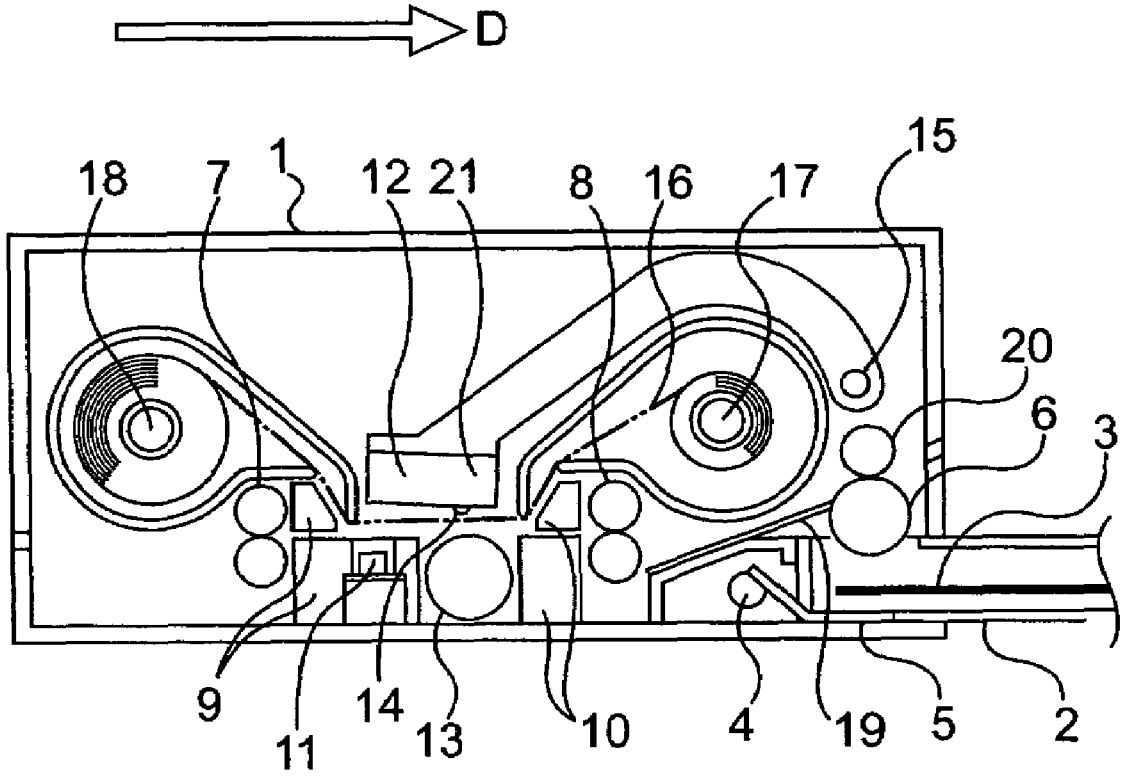
FIG. 1 is a side view illustrating the structure of a printer according to an embodiment of the present invention.

FIG. 1 is a diagram illustrating a printer 1. Referring to FIG. 1, the printer 1 starts a printing operation when image information is transmitted from a digital device, such as a computer and a digital camera, to the printer 1 via a connection cable or the like. First, a recording sheet 3 placed on a paper tray 2 is brought into press-contact with a paper input/output roller 6 by an elevation plate 5 that pivots around an elevation plate shaft 4. Accordingly, the recording sheet 3 is supplied to the printer 1.

Then, the recording sheet 3 is conveyed upstream by a pair of upstream conveying rollers 7, which define an upstream conveying device, and a pair of downstream conveying rollers 8, which define a downstream conveying device. When a print start edge of the recording sheet 3 reaches a leading-edge detection sensor 11, the upstream conveying device 7 and the downstream conveying device 8 stop in response to a command issued by the printer 1. Until the recording sheet 3 reaches this position after being supplied to the printer 1, a gap sized enough to allow the recording sheet 3 to pass therethrough is provided between a thermal head 12, which defines a printing device 21, and a platen roller 13.

Next, the upstream conveying device 7 and the downstream conveying device 8 start conveying the recording sheet 3 in a direction opposite to the direction in which the recording sheet 3 has been conveyed (that is, in the direction shown by the arrow D or in the direction from upstream to downstream) in response to a command from the printer 1. The recording sheet 3 is guided to a position between the thermal head 12 and the platen roller 13 by a pair of upstream guides 9 that respectively guide an upper surface and a lower surface of the recording sheet 3. Then, the recording sheet 3 is stopped when the print start edge of the recording sheet 3 reaches a line of heater elements 14 on the thermal head 12.

Then, the thermal head 12 starts moving around a head arm shaft 15 towards the platen roller 13 and presses an ink ribbon 16 and the recording sheet 3 against the platen roller 13. The platen roller 13 is rotatably supported in the printer 1.

Next, a process of printing on the recording sheet 3 is started. More specifically, electricity is supplied to the heater elements 14 on the thermal head 12 on the basis of the image information, so that ink on the ink ribbon 16 is transferred onto the recording sheet 3. The ink ribbon 16 can have a width larger than a width of the recording sheet. At the same time, the upstream conveying device 7 starts conveying the recording sheet 3 downstream, and ribbon-winding members 17 and 18 start to wind the ink ribbon 16 from which the ink is transferred onto the recording sheet 3.

Figure 2:
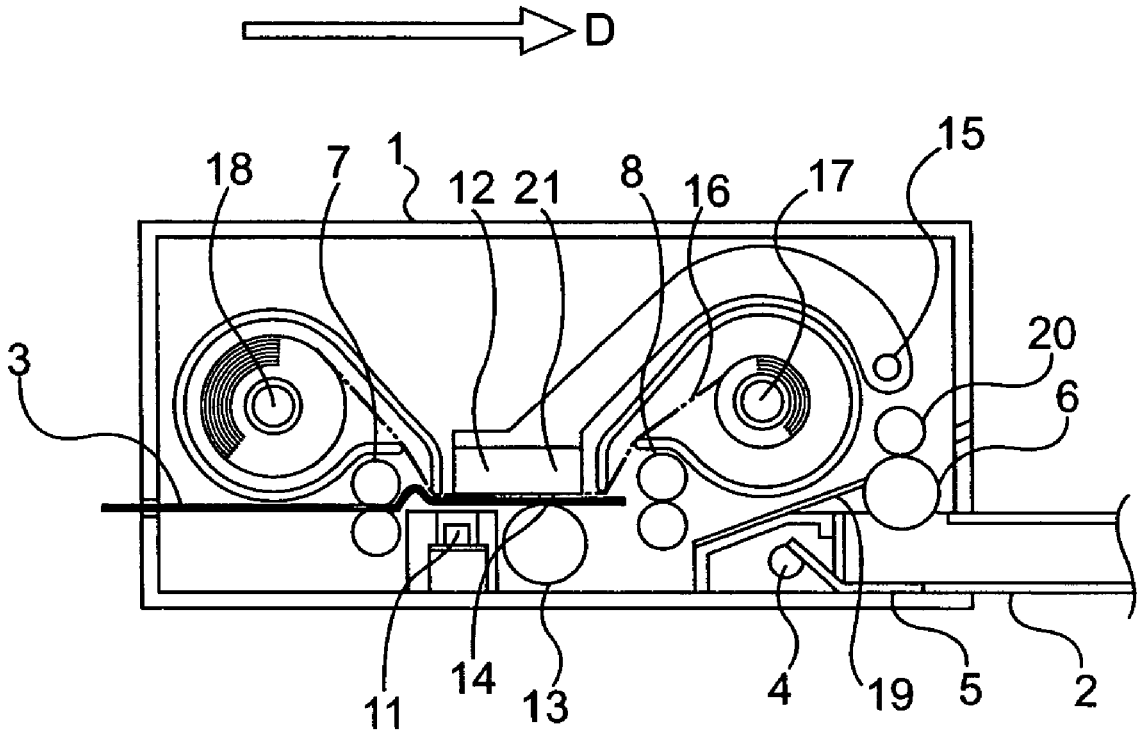
FIG. 2 is a side view illustrating the printer showing the state in which an upstream guide and a downstream guide are removed.

If, for example, the upstream guides 9 are not provided at positions shown in FIG. 1, there is a risk that the recording sheet 3 will be deflected, as shown in FIG. 2, since a large resistance is applied when the recording sheet 3 is inserted between the thermal head 12 and the platen roller 13. If the recording sheet 3 is deflected in this manner, the conveying speed of the recording sheet 3 varies, which may result in print defects like uneven density and color misalignment in the printed image. To prevent this, the movement of the recording sheet 3 is restricted by the upstream guides 9.

A predetermined region of the recording sheet 3 that is adjacent to the leading edge passes the line of heater elements 14 on the thermal head 12 before the leading edge of the recording sheet 3 reaches the downstream conveying device 8. This region is printed on while the recording sheet 3 is being conveyed by the conveying device 7. During this time, the downstream conveying device 8 does not contribute to conveying the recording sheet 3.

Next, after the print start edge of the recording sheet 3 that is being conveyed downstream reaches the downstream conveying device 8, the recording sheet 3 is conveyed by both the upstream conveying device 7 and the downstream conveying device 8.

Figure 3:
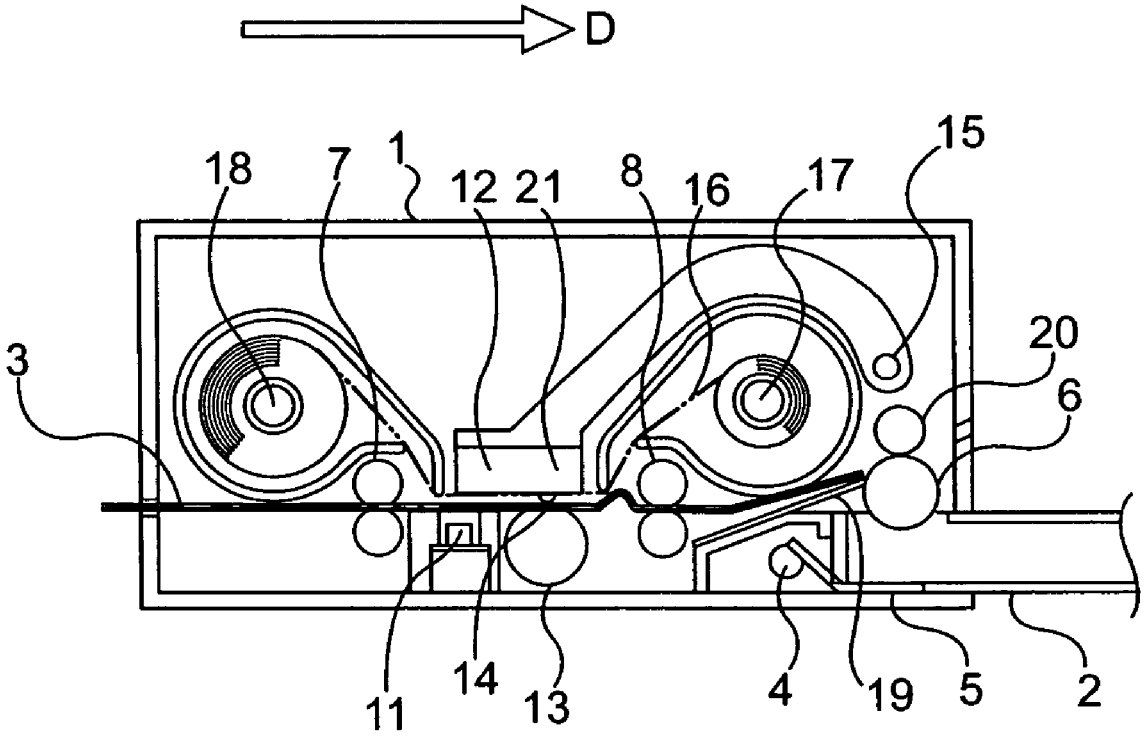
FIG. 3 is a side view illustrating the printer showing the state in which the upstream guide and the downstream guide are removed.

If, for example, downstream guides 10 are not provided at positions shown in FIG. 1, there is a risk that the recording sheet 3 will be deflected, as shown in FIG. 3, since the recording sheet 3 tends to travel upward together with the ink ribbon 16. Similar to the case in which the upstream guides 9 are omitted, this may lead to print defects. To prevent this, the movement of the recording sheet 3 is restricted by the pair of downstream guides 10 for guiding an upper surface and a lower surface of the recording sheet 3. The recording sheet 3 is conveyed by the upstream conveying device 7 and the downstream conveying device 8 until the recording sheet leaves the line of heater elements 14 on the thermal head 12. Then, the operation of conveying the recording sheet 3 with the upstream conveying device 7 and the downstream conveying device 8 and the operation of winding the ink ribbon 16 are stopped. Thus, the printing operation for printing an image of a first color is finished.

Next, the recording sheet 3 is conveyed upstream until the print start edge thereof reaches the leading-edge detection sensor 11. Then, the recording sheet 3 is conveyed downstream again to form an image of a second color. These processes are repeated several times to print images of different colors on the recording sheet 3. Accordingly, a full-color image is obtained. After the full-color image is formed, the recording sheet 3 is guided along a paper output path by a flap 19, and is output to the paper tray 2 by the paper input/output roller 6 and a paper-output press roller 20.

In the printer 1 of the present embodiment, the upstream conveying device and the downstream conveying device are respectively arranged upstream and downstream of the printing device. Therefore, the recording sheet 3 can be printed on without leaving a margin along the print start edge or the print end edge. In addition, since the upstream guides 9 and the downstream guides 10 are provided, deflection of the recording sheet 3 is prevented. Therefore, print defects can be prevented and high-quality images can be printed on the recording sheet 3 with high stability.

Next, an embodiment of marginless printing will be described below.

The structure of a printer according to this embodiment is similar to that explained with reference to FIGS. 1, 2, and 3.

When a print operation is started, the recording sheet 3 placed on the paper tray 2 is supplied and is conveyed until the print start edge of the recording sheet 3 reaches the leading-edge detection sensor 11. Then, the upstream conveying device 7 and the downstream conveying device 8 stop in response to a command issued by the printer 1.

Then, the thermal head 12 starts moving around the head arm shaft 15 towards the platen roller 13 in response to a command from the printer 1, and stops at a position where the ink ribbon 16 and the platen roller 13 are spaced from each other by a distance smaller than the thickness of the recording sheet 3.

Then, the upstream conveying device 7 starts conveying the recording sheet 3. When the leading edge of the recording sheet 3 reaches a predetermined position near the line of heater elements 14 on the thermal head 12, electricity is supplied to the heater elements 14 on the basis of the image information. At the same time, the ribbon-winding members 17 and 18 start to wind the ink ribbon 16 from which the ink is transferred onto the recording sheet 3. More specifically, the thermal transfer operation is started before the leading edge of the recording sheet 3 reaches the line of heater elements 14, so that an image is formed on the recording sheet 3 without leaving a margin along the leading edge thereof.

Since the distance between the ink ribbon 16 and the platen roller 13 is less than the thickness of the recording sheet 3, a large resistance is applied when the recording sheet 3 is inserted between the thermal head 12 and the platen roller 13. The upstream guides 9 prevent the recording sheet 3 from being deflected when the recording sheet 3 is inserted between the thermal head 12 and the platen roller 13. In more detail, the upstream guides 9 come into contact with a deflected portion of the recording sheet 3 that is generated when the recording sheet 3 is inserted between the thermal head 12 and the platen roller 13, thereby preventing the deflected portion from growing larger.

Similarly, the downstream guides 10 prevent the recording sheet 3 from being deflected when the leading edge of the recording sheet 3 reaches the downstream conveying device 8.

The supply of electricity to the heater elements 14 on the thermal head 12 is stopped immediately after the recording sheet 3 conveyed by the upstream conveying device 7 and the downstream conveying device 8 leaves the heater elements 14. At the same time, the operation of winding the ink ribbon 16 is also stopped. Then, the upstream conveying device 7 and the downstream conveying device 8 are also stopped and the printing operation for printing an image of a first color is finished.

Then, the thermal head 12 is moved away from the platen roller 13, and the recording sheet 3 is conveyed upstream by the downstream conveying device 8. Then, the recording sheet 3 is further conveyed upstream by the upstream conveying device 7. Accordingly, the recording sheet 3 is conveyed upstream until the leading edge thereof reaches the leading-edge detection sensor 11. Then, the recording sheet 3 is conveyed downstream again to form an image of a second color. These processes are repeated several times to print images of different colors on the recording sheet 3. Accordingly, a full-color image is obtained. After the full-color image is formed, the recording sheet 3 is guided along a paper output path by the flap 19, and is output to the paper tray 2 by the paper input/output roller 6 and the paper-output press roller 20.

In the printer 1 of the present embodiment, the upstream conveying device and the downstream conveying device are respectively arranged upstream and downstream of the printing device. Therefore, the recording sheet 3 can be printed on without leaving a margin along the print start edge or the print end edge. In addition, since the upstream guides 9 and the downstream guides 10 are provided, deflection of the recording sheet 3 is prevented. Therefore, print defects can be prevented and high-quality images can be printed on the recording sheet 3 with high stability.

As described above, the thermal printer according to the embodiments of the present invention includes the upstream conveying device and the downstream conveying device that are respectively arranged upstream and downstream of the printing device in the recording-sheet conveying direction. The recording sheet is conveyed using the upstream conveying device while a first half of a print region that is adjacent to the print start edge is being printed on, and is conveyed using the downstream conveying device while a second half of the print region that is adjacent to the print end edge is being printed on. In addition, two guide units that define a conveying path of the recording sheet are provided, one of the guide units being positioned between the upstream conveying device and the printing device and the other one of the guide units being positioned between the downstream conveying device and the printing device. Therefore, the recording sheet is prevented from being deflected between the upstream conveying device and the downstream conveying device, and a printed image that is free from print defects like uneven density and color misalignment can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-372770 filed Dec. 24, 2004, which is hereby incorporated by reference herein in its entirety.

What is claimed is:

1. A thermal printer comprising:

a recording head configured to record images on a recording medium on the basis of recording information;

a platen roller configured to press the recording medium against the recording head;

a downstream conveying device positioned downstream of the recording head in a conveying direction of the recording medium and including a grip roller and a pinch roller;

an upstream conveying device positioned upstream of the recording head in the conveying direction of the recording medium and including a grip roller and a pinch roller, wherein the recording head records on the recording medium while the leading edge of the recording medium is being inserted between the recording head and the platen roller by the upstream conveying device so that no margin is formed along the leading edge of the recording medium;

a pair of guide units adapted to guide both sides of the recording medium and provided between the upstream conveying device and the recording head; and an ink-sheet conveying device configured to convey an ink sheet such that the ink sheet passes between the recording head and the platen roller, the ink sheet having ink applied thereto, wherein the recording head transfers the ink applied to the ink sheet onto the recording medium, and wherein the recording head continues the recording operation until after the trailing edge of the recording medium leaves the recording head and the platen roller so that no margin is formed along the trailing edge of the recording medium.

2. The thermal printer according to claim 1, wherein a width of the ink sheet is larger than a width of the recording medium, and wherein the recording head heats the ink sheet over a region having a width larger than the width of the recording medium.

3. The thermal printer according to claim 1, wherein the pair of guide units prevent deflection of the recording medium between the upstream conveying device and the recording head.

4. The thermal printer according to claim 3, wherein the pair of guide units prevents deflection of the recording medium when the leading edge of the recording medium is inserted between the recording head and the platen roller.

5. A thermal printer comprising:

a recording head configured to record images on a recording medium on the basis of recording information;

a platen roller configured to press the recording medium against the recording head;

a downstream conveying device positioned downstream of the recording head in a conveying direction of the recording medium and including a grip roller and a pinch roller;

an upstream conveying device positioned upstream of the recording head in the conveying direction of the recording medium and including a grip roller and a pinch roller, wherein the recording head records on the recording medium while the leading edge of the recording medium is being inserted between the recording head and the platen roller by the upstream conveying device so that no margin is formed along the leading edge of the recording medium;

a pair of guide units adapted to guide both sides of the recording medium and provided between the upstream conveying device and the recording head; and an ink-sheet conveying device configured to convey an ink sheet such that the ink sheet passes between the recording head and the platen roller, the ink sheet having ink applied thereto, wherein the recording head transfers the ink applied to the ink sheet onto the recording medium, and wherein, after the recording medium passes the recording head, the downstream conveying device and the upstream conveying device successively convey the recording medium upstream until the recording medium passes the recording head.

* * * * *